US007960953B2

(12) United States Patent
Inoue

(10) Patent No.: US 7,960,953 B2
(45) Date of Patent: Jun. 14, 2011

(54) REGULATOR CIRCUIT AND CAR PROVIDED WITH THE SAME

(75) Inventor: Hiroki Inoue, Kyoto (JP)

(73) Assignee: Rohm Co., Ltd. (JP)

( * ) Notice: Subject to any disclaimer, the term of this patent is extended or adjusted under 35 U.S.C. 154(b) by 349 days.

(21) Appl. No.: 12/096,755

(22) PCT Filed: Dec. 6, 2006

(86) PCT No.: PCT/JP2006/324334

§ 371 (c)(1),
(2), (4) Date: Jun. 9, 2008

(87) PCT Pub. No.: WO2007/066680

PCT Pub. Date: Jun. 14, 2007

(65) Prior Publication Data

US 2009/0273237 A1 Nov. 5, 2009

(30) Foreign Application Priority Data

Dec. 8, 2005 (JP) ..... 2005-355146

(51) Int. Cl.
*G05F 1/40* (2006.01)
*G05F 5/00* (2006.01)

(52) U.S. Cl. ..... 323/273; 323/303

(58) Field of Classification Search ..... 323/269, 323/270, 273, 275, 276, 279, 280, 299, 303
See application file for complete search history.

(56) References Cited

U.S. PATENT DOCUMENTS

| | | | | |
|---|---|---|---|---|
| 5,570,004 | A * | 10/1996 | Shibata | 323/303 |
| 6,320,363 | B1 * | 11/2001 | Oglesbee et al. | 323/303 |
| 6,897,637 | B2 * | 5/2005 | Chen et al. | 323/274 |
| 6,958,596 | B1 * | 10/2005 | Sferrazza et al. | 323/303 |

FOREIGN PATENT DOCUMENTS

| | | |
|---|---|---|
| JP | 53-67848 | 6/1978 |
| JP | 2001-34351 | 2/2001 |
| JP | 2001-337729 | 12/2001 |
| JP | 2002-189522 | 7/2002 |
| JP | 2002-222929 | 8/2002 |
| JP | 2003-44150 | 2/2003 |
| JP | 2006-65836 | 3/2006 |

OTHER PUBLICATIONS

Chinese Office Action for Chinese Patent Application No. 200680017592.1 issued Dec. 11, 2009 with English translation.

International Preliminary Report on Patentability for International Application No. PCT/JP2006/324334 issued Jun. 11, 2008 with English Translation.

International Search Report for International Application No. PCT/JP2006/324334 mailed Feb. 20, 2007 with English Translation.

* cited by examiner

*Primary Examiner* — Matthew V Nguyen

(74) *Attorney, Agent, or Firm* — Cantor Colburn LLP

(57) ABSTRACT

A regulator circuit stabilizes the input voltage applied to an input terminal before outputting the output voltage via an output terminal. An output transistor is provided between the input terminal and the output terminal. An error amplifier adjusts the voltage applied to the control terminal of the output transistor such that a voltage that corresponds to the output voltage approaches a predetermined reference voltage. A fluctuation detection capacitor is provided on a path from the input terminal to the grounded terminal. One terminal of the fluctuation detection capacitor is set to a fixed electric potential. In a case that the input voltage is lower than the voltage at the other terminal of the fluctuation detection capacitor, an undershoot suppressing circuit forcibly reduces the gate voltage of the output transistor.

17 Claims, 6 Drawing Sheets

100a

REGULATOR CIRCUIT AND CAR PROVIDED WITH THE SAME

CROSS REFERENCE TO RELATED APPLICATIONS

This is a U.S. national stage of application No. PCT/JP2006/324334, filed on 6 Dec. 2006. Priority under 35 U.S.C. §119(a) and 35 U.S.C. §365(b) is claimed from Japanese Application No. 2005-355146, filed 8 Dec. 2005, the disclosure of which is also incorporated herein by reference.

BACKGROUND OF THE INVENTION

1. Field of the Invention

The present invention relates to a regulator circuit which maintains stable output voltage.

2. Description of the Related Art

In order to maintain stable operation of an electronic circuit, there is a demand for maintaining a stable power supply voltage at a constant value. Also, an apparatus mounting such electronic circuits does not always include a power supply voltage necessary for each of such electronic circuits. For example, a 5V microcomputer mounted in an automobile requires a power supply voltage of 5 V. However, a battery mounted in the automobile can only supply an unstable voltage of 12 V to such a 5V microcomputer mounted in the automobile. With such an arrangement, a linear regulator circuit (which will be simply referred to as a "regulator circuit" hereafter) is widely used in order to generate by means of a simple configuration a stable power supply voltage necessary for such an electronic circuit.

In general, such a regulator circuit includes an error amplifier, an output transistor, and a feedback resistor. The error amplifier has a function of making a comparison between a desired reference voltage value and the output voltage input as a feedback signal via the feedback resistor. Furthermore, the error amplifier has a function of controlling the voltage applied to the control terminal of the control circuit such that these two voltages thus compared approach each other. With such an arrangement, in a case that there is a change in the input voltage or a change in the load, there is a need to adjust the voltage applied to the control terminal of the output transistor according to the change in the input voltage or the change in the load.

In some cases, a MOSFET (Metal Oxide Semiconductor Field Effect Transistor) is employed as the output transistor in order to provide reduced current consumption. Let us consider an arrangement employing such a MOSFET as the output transistor. With such an arrangement, in order to provide a large current capacity, there is a need to increase the transistor size. This leads to a large gate capacitance, leading to a response delay of the gate voltage, which is controlled by the error amplifier, with respect to the change in the input voltage or the change in the load. This response delay leads to the output voltage being overshot or undershot. Also, with such an arrangement, the output voltage being thus overshot or undershot occurs due to the change in the load, i.e., the change in the output current.

In order to solve such a problem, a technique has been proposed in which the current that flows through the load from the output transistor is monitored, and the bias current applied to the error amplifier is increased according to the current thus monitored, thereby increasing the response speed of the regulator.

[Patent Document 1]

Japanese Patent Application Laid-open No. 2001-34351

With an arrangement employing the technique described in the aforementioned document, in a case that a great amount of current flows through the load, a great amount of bias current flows through the error amplifier, thereby providing the regulator circuit with an increased response speed. However, in a case that the current that flows through the load is rapidly reduced, the response speed is reduced due to the reduction in the current. In some cases, such a reduction in the response speed leads to an undesired fluctuation in the output voltage. Furthermore, such an arrangement has a problem of difficulty in suppressing the fluctuation of the output voltage occurring due to the fluctuation of the input voltage.

SUMMARY OF THE INVENTION

The present invention has been made in view of such a problem. Accordingly, it is a general purpose of the present invention to provide a regulator circuit which is capable of suppressing fluctuations in the output voltage that arise from fluctuations in the input voltage or the output current, while suppressing an increase in power consumption in the stable state.

An embodiment of the present invention relates to a regulator circuit which stabilizes an input voltage applied to an input terminal, and which outputs an output voltage via an output terminal. The regulator circuit comprises: an output transistor provided between the input terminal and the output terminal; an error amplifier which adjusts a voltage at a control terminal of the output transistor such that the voltage that corresponds to the output voltage approaches a predetermined reference voltage; a fluctuation detection capacitor which is provided on a path from the input terminal to the grounded terminal, and one terminal of which is set to a fixed electric potential; and an undershoot suppressing circuit which provides a function whereby, in a case that the input voltage is lower than the voltage at the other terminal of the fluctuation detection capacitor, the voltage at the control terminal of the output transistor is forcibly reduced.

The term "control terminal of the output transistor" as used here represents the gate terminal of a MOSFET or the base terminal of a bipolar transistor. In a case that the input voltage is lower than the other terminal of the fluctuation detection capacitor due to a rapid drop in the input voltage, the undershoot suppressing circuit forcibly reduces the voltage applied to the control terminal of the output transistor, thereby raising the level of the ON state of the output transistor. Such an arrangement suppresses undershooting of the output voltage.

Also, the undershoot suppressing circuit may include a detection transistor which is provided on a path from the other terminal of the fluctuation detection capacitor to the grounded terminal, and the control terminal of which is connected to the input terminal. Also, the undershoot suppressing circuit may have a function of forcibly reducing the voltage at the control terminal of the output transistor using the current that flows through the detection transistor.

Also, the detection transistor may be a P-channel field effect transistor, the gate of which is connected to the input terminal, and the source of which is connected to the other terminal of the fluctuation detection capacitor. With such an arrangement, in a case that the input voltage applied to the input terminal is lower than the voltage at the other terminal of the fluctuation detection capacitor, and, accordingly, in a case that the voltage applied between the gate and source of the detection transistor is higher than a threshold voltage, the detection transistor is in the ON state, thereby generating a current.

Also, the undershoot suppressing circuit may include a current feedback circuit which extracts from the control terminal of the output transistor a current that corresponds to a current that flows through the detection transistor. Also, the current feedback circuit may include: a first transistor which is provided on the path of the detection transistor; and a second transistor which, together with the first transistor, forms a current mirror circuit, and one terminal of which is connected to the control terminal of the output transistor.

With such an arrangement, a current flows through the detection transistor during a period in which the input voltage fluctuates. Thus, such an arrangement suppresses undershooting of the output voltage, while also suppressing an increase in current consumption in a stable state of the circuit.

Also, the undershoot suppressing circuit may further include a current feedback circuit which inputs a current, which corresponds to a current that flows through the detection transistor, as a feedback signal for a differential current output from a differential amplification circuit provided as an input stage of the error amplifier. Also, the current feedback circuit may include: a first transistor provided on the path of the detection transistor; and a second transistor which, together with the first transistor, forms a current mirror circuit, and one terminal of which is connected to one component that forms the differential pair for the differential amplification circuit provided as an input stage of the error amplifier.

With such an arrangement, in a case that the input voltage drops, a feedback is applied to the differential current so as to reduce the output voltage of the error amplifier (i.e., the voltage at the control terminal of the output transistor). Such an arrangement suitably suppresses undershooting of the output voltage.

Also, the regulator circuit may further include an overshoot suppressing circuit which provides a function whereby, in a case that a current flows from the input terminal into the other terminal of the fluctuation detection capacitor, the voltage at the control terminal of the output transistor is forcibly raised. Also, the overshoot suppressing circuit may supply to the control terminal of the output transistor a current that corresponds to the current that flows from the input terminal into the other terminal of the fluctuation detection capacitor. Also, the overshoot suppressing circuit may include: a third transistor provided on a path from the input terminal to the other terminal of the fluctuation detection capacitor; and a fourth transistor which, together with the third transistor, forms a current mirror circuit, and one terminal of which is connected to the control terminal of the output transistor.

In a case that the input voltage rises, a transient current flows into the fluctuation detection capacitor. In this case, the voltage applied to the control terminal of the output transistor is increased using the aforementioned current. This reduces the level of the ON state of the output transistor, thereby suppressing overshooting of the output voltage.

Also, the regulator circuit may further include: a pre-regulator circuit which stabilizes the power supply voltage input to the input terminal, based upon a constant current generated by a constant current source; and a reference voltage generating circuit which generates the reference voltage based upon the output voltage of the pre-regulator circuit. With such an arrangement, the undershoot suppressing circuit may add to the aforementioned constant current a current that corresponds to the current flowing through the detection transistor. With such an arrangement, the current generated by the undershoot suppressing circuit enables the pre-regulator circuit to generate voltage even in a situation in which the constant current is not generated due to a drop in the input voltage.

Also, the circuit may be integrally formed on a single semiconductor substrate. Examples of arrangements "integrally formed" include: an arrangement in which all the components of a circuit are formed on a semiconductor substrate; and an arrangement in which principal components of a circuit are integrally formed. With such an arrangement, adjusting components for adjusting circuit constants, such as a part of resistors, capacitors, etc., may be provided in the form of components external to the semiconductor substrate. With such an arrangement, the regulator circuit is integrally formed in the form of a single LSI, thereby reducing the circuit area.

Another embodiment of the present invention relates to an automobile. The automobile includes: a battery; and a regulator circuit according to any one of the above-described embodiments, which stabilizes the voltage supplied from the battery before supplying the output voltage to a load.

A battery mounted in an automobile has a problem of large fluctuations in the output voltage. Accordingly, such an arrangement employing the above-described regulator circuit suppresses undershooting and overshooting of the output voltage, thereby supplying stable voltage to a load.

Note that any combination of the aforementioned components or any manifestation of the present invention realized by replacement of a method, an apparatus, a system, and so forth, is effective as an embodiment of the present invention.

It is to be noted that any arbitrary combination or rearrangement of the above-described structural components and so forth is effective as and encompassed by the present embodiments.

Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

In the present specification, the state represented by the phrase "the member A is connected to the member B" includes a state in which the member A and the member B are physically and directly connected to each other. Also, the state represented by such a phrase include a state in which the member A and the member B are indirectly connected to each other via another member that does not affect the electric connection between the member A and the member B.

First Embodiment

Figure 1:
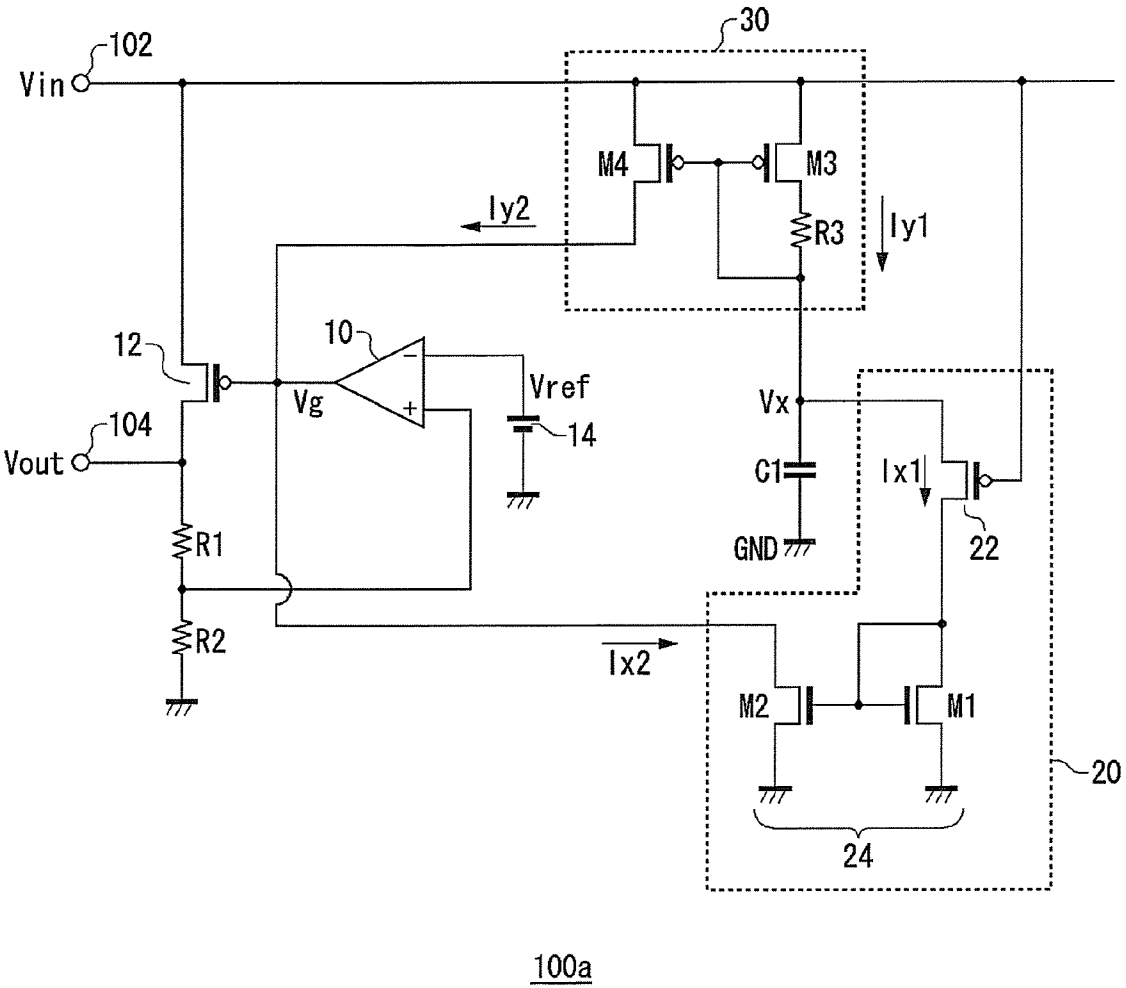
FIG. 1 is a circuit diagram which shows a configuration of a regulator circuit according to a first embodiment.

FIG. 1 shows a configuration of a regulator circuit 100*a* according to a first embodiment of the present invention. In the following drawings, the same reference components are denoted by the same reference numerals, and description thereof will be omitted as appropriate. The regulator circuit 100*a* according to the present embodiment stabilizes the input voltage Vin which is applied to an input terminal 102, and outputs the output voltage Vout via an output terminal 104. The regulator circuit 100*a* includes an error amplifier 10, an output transistor 12, a first resistor R1, a second resistor R2, a reference voltage source 14, a fluctuation detection capacitor C1, an undershoot suppressing circuit 20, and an overshoot suppressing circuit 30. In the following description, as necessary, the reference numerals which denote a voltage signal, a current signal, resistance, capacitance, etc., also denote the corresponding voltage value, current value, resistance value, capacitance value, etc., respectively.

The error amplifier 10, the output transistor 12, the first resistor R1, and the second resistor R2 form a typical linear regulator. The output transistor 12 is provided between the input terminal 102 and the output terminal 104. With such an arrangement, the on-resistance of the output transistor 12 is controlled such that the output voltage Vout matches a desired voltage, whereby the input voltage Vin is dropped to the output voltage Vout. With the present embodiment, the output transistor 12 is a P-channel MOSFET. The source of the output transistor 12 is connected to the input terminal 102 of the regulator circuit 100*a*. On the other hand, the drain thereof is connected to the output terminal 104 of the regulator circuit 100*a*. Furthermore, the output of the error amplifier 10 is connected to the gate, which is a control terminal, of the output transistor 12. With such an arrangement, the error amplifier 10 controls the gate voltage Vg.

The reference voltage Vref output from the reference voltage source 14 is connected to the inverting input terminal (−) of the error amplifier 10. On the other hand, the output voltage Vout is divided by the first resistor R1 and the second resistor R2. The voltage R2/(R1+R2)×Vout thus divided is input to the non-inverting input terminal (+) of the error amplifier 10 in the form of a feedback input signal. The error amplifier 10 adjusts the gate voltage Vg of the output transistor 12 such that the voltage input to the inverting terminal matches the voltage input to the non-inverting terminal. Thus, such an arrangement stabilizes the output voltage such that it satisfies the Expression Vout=(R1+R2)/R2×Vref, regardless of the value of the input voltage Vin.

The fluctuation detection capacitor C1 is provided on a path from the input terminal 102 to a grounded terminal GND. Furthermore, one terminal of the fluctuation detection capacitor C1 is grounded, i.e., is set to the fixed electric potential. In a case that the input voltage Vin, which is applied to the input terminal 102, is smaller than the output voltage Vx of the other terminal of the fluctuation detection capacitor C1, the undershoot suppressing circuit 20 forcibly reduces the gate voltage Vg of the output transistor 12.

The undershoot suppressing circuit 20 includes a detection transistor 22 and a current feedback circuit 24. The detection transistor 22 is provided on a path from the other terminal of the fluctuation detection capacitor C1 up to the grounded terminal GND. Furthermore, the gate thereof is connected to the input terminal 102. With the present embodiment, the detection transistor 22 comprises a P-channel MOSFET. The source of the detection transistor 22 is connected to the other terminal of the fluctuation detection capacitor C1. On the other hand, the drain thereof is connected to the current feedback circuit 24. Also, the detection transistor 22 may comprise a PNP bipolar transistor.

The current feedback circuit 24 extracts the current Ix2 from the gate, which is a control terminal of the output transistor 12, according to the current Ix1 that flows through the detection transistor 22. The current feedback circuit 24 includes a first transistor M1 and a second transistor M2. Each of the first transistor M1 and the second transistor M2 is an N-channel MOSFET, the source of which is grounded. The first transistor M1 is provided on the current path of the detection transistor 22. Furthermore, the second transistor M2 is connected to the first transistor M1 so as to form a common gate and a common source, which forms a current-mirror circuit. Moreover, the drain of the second transistor M2 is connected to the gate of the output transistor 12.

The current Ix2 that flows through the second transistor M2 is proportional, by a constant factor, to the current Ix1 that flows through the detection transistor 22. Such an arrangement has a function of forcibly reducing the gate voltage Vg by pulling the current Ix2 from the gate of the output transistor 12.

In a case that a current flows into the other terminal of the fluctuation detection capacitor C1 from the input terminal 102, the overshoot suppressing circuit 30 forcibly raises the gate voltage Vg of the output transistor 12. The overshoot suppressing circuit 30 supplies the current Iy2 to the gate of the output transistor 12 according to the current Iy1 that flows from the input terminal 102 into the other terminal of the fluctuation detection capacitor C1.

With the present embodiment, the overshoot suppressing circuit 30 includes a third transistor M3, a fourth transistor M4, and a gain adjustment resistor R3. The third transistor M3 and the gain adjustment resistor R3 are serially connected to each other on a path from the input terminal 102 up to the other terminal of the fluctuation detection capacitor C1. The third transistor M3 is a P-channel MOSFET. The source of the third transistor M3 is connected to the input terminal 102. Furthermore, the drain thereof is connected to the gain adjustment resistor R3. Also, the fourth transistor M4 is a P-cannel MOSFET. The source of the fourth transistor M4 is connected to the input terminal 102. Furthermore, the gate thereof is connected to the gate of the third transistor M3. Together, the fourth transistor M4 and the third transistor M3 form a current mirror circuit. With such an arrangement, the third transistor M3 and the fourth transistor M4 supply the current Iy2 to the gate of the output transistor, which is proportional, by a constant factor, to the current Iy1 that flows into the fluctuation detection capacitor C1 from the input terminal 102. Thus, such an arrangement provides a function of forcibly raising the gate voltage Vg.

Let us consider a case in which the circuit is in a stable state. In this case, the current that flows through the third transistor M3 is almost zero. Accordingly, the voltage difference between the source and the drain of the third transistor M3 is almost 0 V. Furthermore, the voltage drop of the gain adjustment resistor R3 is almost 0V. Accordingly, approximately the same voltage as the input voltage Vin is input to one terminal of the fluctuation detection capacitor C1. That is to say, the voltage input satisfies the Expression Vx≈Vin. On the other hand, the sum of the drain-source voltage of the third transistor M3 and the voltage drop of the gain adjustment resistor R3 corresponds to the gate-source voltage of the fourth transistor M4. In this case, each of these voltages is extremely small as described above, and accordingly, the fourth transistor M4 is in the OFF state.

Let us consider a case in which there is an increase in the input voltage Vin applied to the input terminal 102. In this case, the voltage applied to the higher potential side of the fluctuation detection capacitor C1 is increased according to the input voltage Vin. Accordingly, transient current Iy1 flows through the third transistor M3 and the gain adjustment resistor R3, thereby charging the fluctuation detection capacitor C1.

The overshoot suppressing circuit 30 amplifies the current Iy1, i.e., creates the current Iy2. The current Iy2 is input to the gate, which is a control terminal, of the output transistor 12 as a feedback signal. Note that the current Iy1 may be amplified with a gain less than 1. With such an arrangement, the ratio of the current Iy1 to Iy2 can be adjusted by adjusting the gain adjustment resistor R3 and the size ratio of the third transistor M3 to the fourth transistor M4. Specifically, in order to increase the current gain, the size ratio of third transistor M3 to the fourth transistor M4 should be increased. Alternatively, the resistance value of the gain adjustment resistor R3 should be increased.

Figure 2:
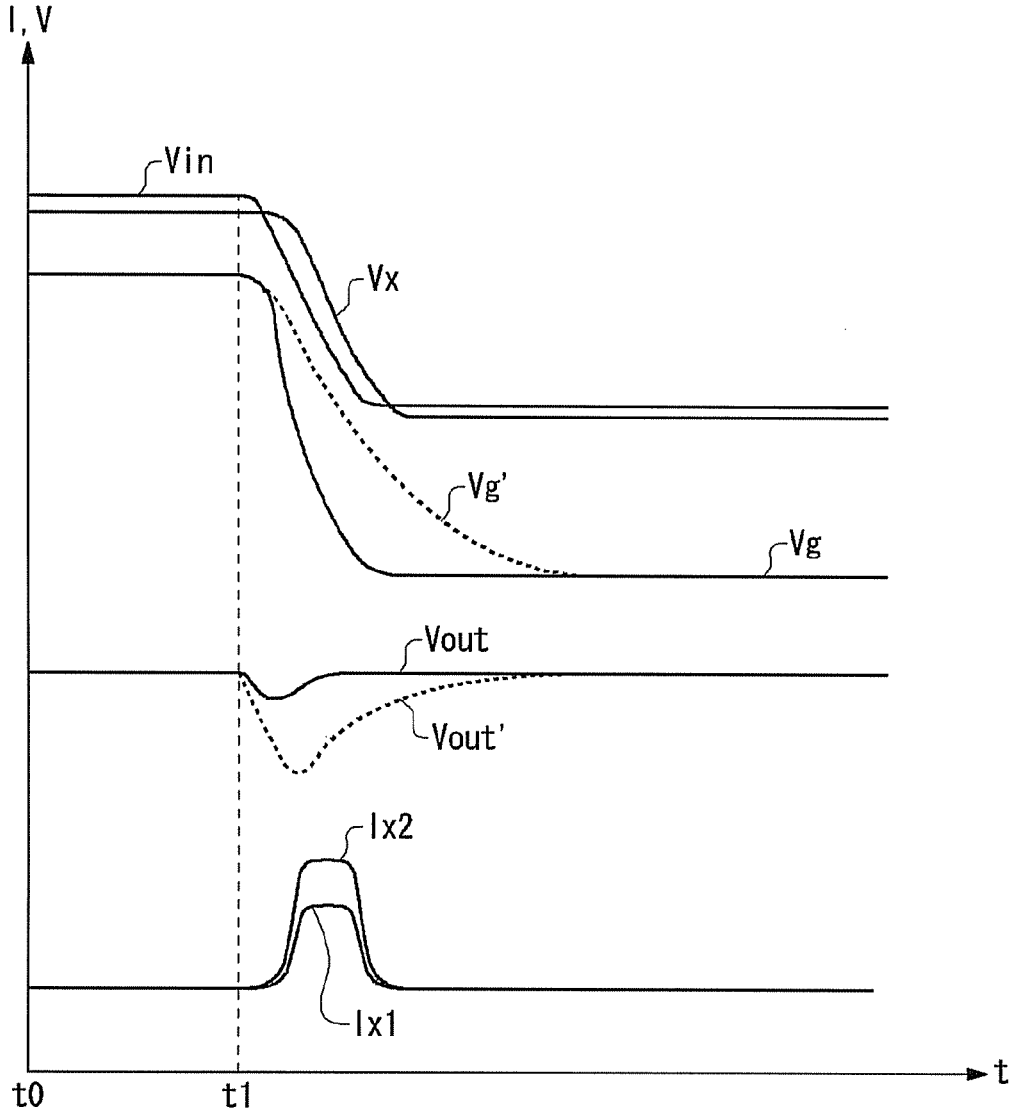
FIG. 2 is an operation waveform diagram for the regulator circuit shown in FIG. 1 when the input voltage rapidly drops.

Description will be made regarding the operation of the regulator circuit 100*a* having the above-described configuration with reference to FIG. 2. FIG. 2 is an operation waveform diagram for the regulator circuit 100*a* when the input voltage Vin rapidly drops.

In order to clarify the undershoot suppressing mechanism of the regulator circuit 100*a* according to the present embodiment, first, description will be made regarding the operation of the regulator circuit 100*a* without the undershoot suppressing circuit 20 and the overshoot suppressing circuit 30. The gate voltage Vg' and the output voltage Vout', which are operation waveforms of the regulator circuit 100*a* having such a configuration, are indicated by the broken lines in FIG. 2.

During a period from the point in time t0 to the point in time t1, the input voltage Vin is constant, i.e., the circuit is in a stable state. In this case, such an arrangement provides the stable output voltage Vout=(R1+R2)/R2×Vref. Now, let us consider a case in which the input voltage Vin rapidly drops at the point in time t1.

The output transistor 12 included in the regulator circuit 100*a* has gate capacitance Cg between the gate and the source thereof. Accordingly, there is a need to charge or discharge the gate capacitance Cg before the gate voltage Vg' is changed. Here, the rate of change in the gate voltage Vg' over time can be represented using the gate capacitance Cg and the charge/discharge current I, i.e., the Expression dVg'/dt=I/Cg, which is inversely proportional to the gate capacitance. Accordingly, in a case that the gate capacitance Cg of the output transistor 12 is large, there is a large delay in the change in the gate voltage Vg' with respect to the change in the input voltage Vin and the change in the output voltage Vout.

With such an arrangement, the gate voltage Vg' does not exhibit a sufficient response to a rapid drop in the input voltage Vin which is the source voltage applied to the output transistor 12. This reduces the gate-source voltage of the output transistor 12. As a result, the output voltage Vout', which is the drain voltage, is temporarily reduced, leading to the output voltage Vout' being undershot.

Next, description will be made regarding the operation of the regulator circuit 100*a* including the undershoot suppressing circuit 20 according to the embodiment with reference to the voltage waveforms Vg and Vout, which are indicated by solid lines in FIG. 2.

During a period from the point in time t0 to the point in time t1, the circuit is in a stable state. In this case, the voltage Vx at one terminal of the fluctuation detection capacitor C1 is approximately the same as the input voltage Vin.

At the point in time t1, something causes the input voltage Vin to rapidly drop. With such an arrangement, there is no discharge path for the charge stored in the fluctuation detection capacitor C1. Accordingly, in this case, the voltage Vx at the one terminal of the fluctuation detection capacitor C1 is not reduced immediately after a rapid drop in the input voltage Vin. As a result, the input voltage Vin becomes smaller than the voltage Vx at the one terminal of the fluctuation detection capacitor C1. In a case that the gate-source voltage (Vx−Vin) of the detection transistor 22 becomes greater than a threshold voltage Vt, the detection transistor 22 is turned on, whereupon the current Ix1 flows.

The current Ix1 is amplified by the current feedback circuit 24, thereby creating the current Ix2. The gate capacitance Cg of the output transistor 12 is discharged by the current Ix2. Accordingly, the gate voltage Vg of the output transistor 12 is reduced following the input voltage Vin. This prevents the gate-source voltage of the output transistor 12 from becoming extremely small, thereby suppressing the output voltage Vout being undershot.

Figure 3:
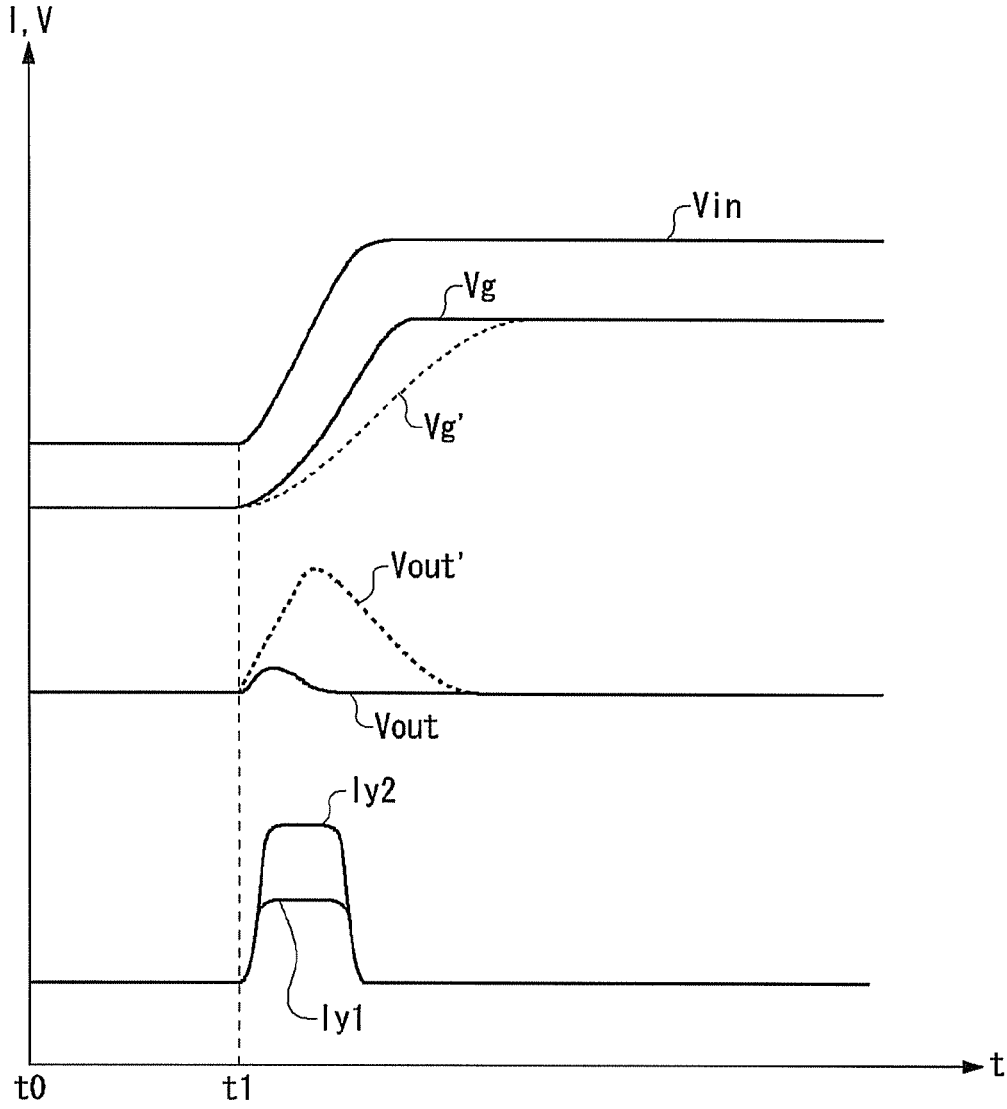
FIG. 3 is an operation waveform diagram for the regulator circuit shown in FIG. 1 when the input voltage rapidly rises.

Next, description will be made regarding the overshoot suppressing mechanism of the regulator circuit 100*a* according to the present embodiment. FIG. 3 is an operation waveform diagram for the regulator circuit 100*a* when the input voltage Vin rapidly rises.

In order to clarify the overshoot suppressing mechanism of the regulator circuit 100*a* according to the present embodiment, first, description will be made regarding the regulator circuit 100*a* without the overshoot suppressing circuit 30. The gate voltage Vg' and the output voltage Vout', which are voltage waveforms of the regulator circuit 100*a* having such a configuration, are indicated by the broken lines in FIG. 3.

During a period from the point in time t0 to the point in time t1, the input voltage Vin is constant, i.e., the circuit is in a stable state. In this case, such an arrangement provides the stable output voltage Vout=(R1+R2)/R2×Vref. Now, let us consider a case in which the input voltage Vin rapidly rises at the point in time t1.

In this case, there is a delay in the response of the gate voltage Vg' because of a CR time constant circuit due to the gate capacitance. Accordingly, such an arrangement does not provide a sufficient response to the rapid increase in the input voltage Vin, which is the source voltage. This leads to a temporary increase in the gate-source voltage of the output transistor 12, resulting in the output voltage Vout being overshot.

Next, description will be made regarding the operation of the regulator circuit 100*a* including the overshoot suppressing circuit 30 operating in order to prevent the output voltage Vout being overshot, with reference to the voltage waveforms Vg and Vout, which are indicated by solid lines in FIG. 3.

During a period from the point in time t0 to the point in time t1, the circuit is in a stable state. At the point in time t1, the input voltage Vin starts to rise. In a case that the input voltage Vin rises, the current Iy1 flows into the fluctuation detection capacitor C1 from the input terminal 102. The current Iy1 is represented using the capacitance value of the fluctuation detection capacitor C1, i.e., by the Expression Iy1≈C1×dVin/dt. Accordingly, in FIG. 3, in a case that there is a change in the input voltage Vin, the current Iy1 flows, which is approximately proportional to the waveform obtained by taking the time differential of the input voltage Vin.

The current Iy1 is amplified by the overshoot suppressing circuit 30, thereby creating the current Iy2. The amplification factor is determined by the third transistor M3, the fourth transistor M4, and the gain adjustment resistor R3, as described above. The current Iy2 thus amplified by the overshoot suppressing circuit 30 is supplied to the gate of the output transistor 12. In this stage, the gate capacitance Cg of the output transistor 12 is charged by the current Iy2. This means that the charge current is increased by the current Iy2, thereby increasing the rate of change in the gate voltage Vg over time according to the relation dVg/dt=I/Cg. As a result, the gate voltage Vg (indicated by the solid line in FIG. 3) rises more rapidly than the gate voltage Vg' (indicated by the broken line in FIG. 3).

Thus, with such an arrangement, the gate-source voltage of the output transistor 12 is adjusted to an appropriate value even in a case that there is a fluctuation in the input voltage Vin, which is the source voltage. Such an arrangement suppresses overshooting of the output voltage Vout (indicated by the solid line), thereby providing an output-voltage stabilizing function that requires only a short period of time.

As described above, with the regulator circuit 100*a* according to the present embodiment, the overshoot suppressing circuit 30 detects the transient current Iy1 that flows during a period in which the input voltage Vin changes. The current Iy1 thus detected is amplified, and the current thus amplified is supplied to the gate terminal of the output transistor 12. Thus, such an arrangement has a function of forcibly raising the gate voltage Vg in order to prevent the output voltage Vout being overshot.

Furthermore, such an arrangement has an advantage of a reduced capacitance value of a capacitor (not shown) ordinarily provided between the output terminal 104 and the grounded terminal, which is due to the undershoot suppressing mechanism and the overshoot mechanism of the regulator circuit 100*a*.

With such an arrangement, the currents Iy1 and Iy2 are proportional to the time derivative of the input voltage Vin as described above. Accordingly, each of the currents Iy1 and Iy2 flows only during a period in which the input voltage Vin changes over time. Thus, the regulator circuit 100*a* according to the present embodiment suppresses overshooting of the output voltage Vout without increasing current consumption in a stable state.

Second Embodiment

Figure 4:
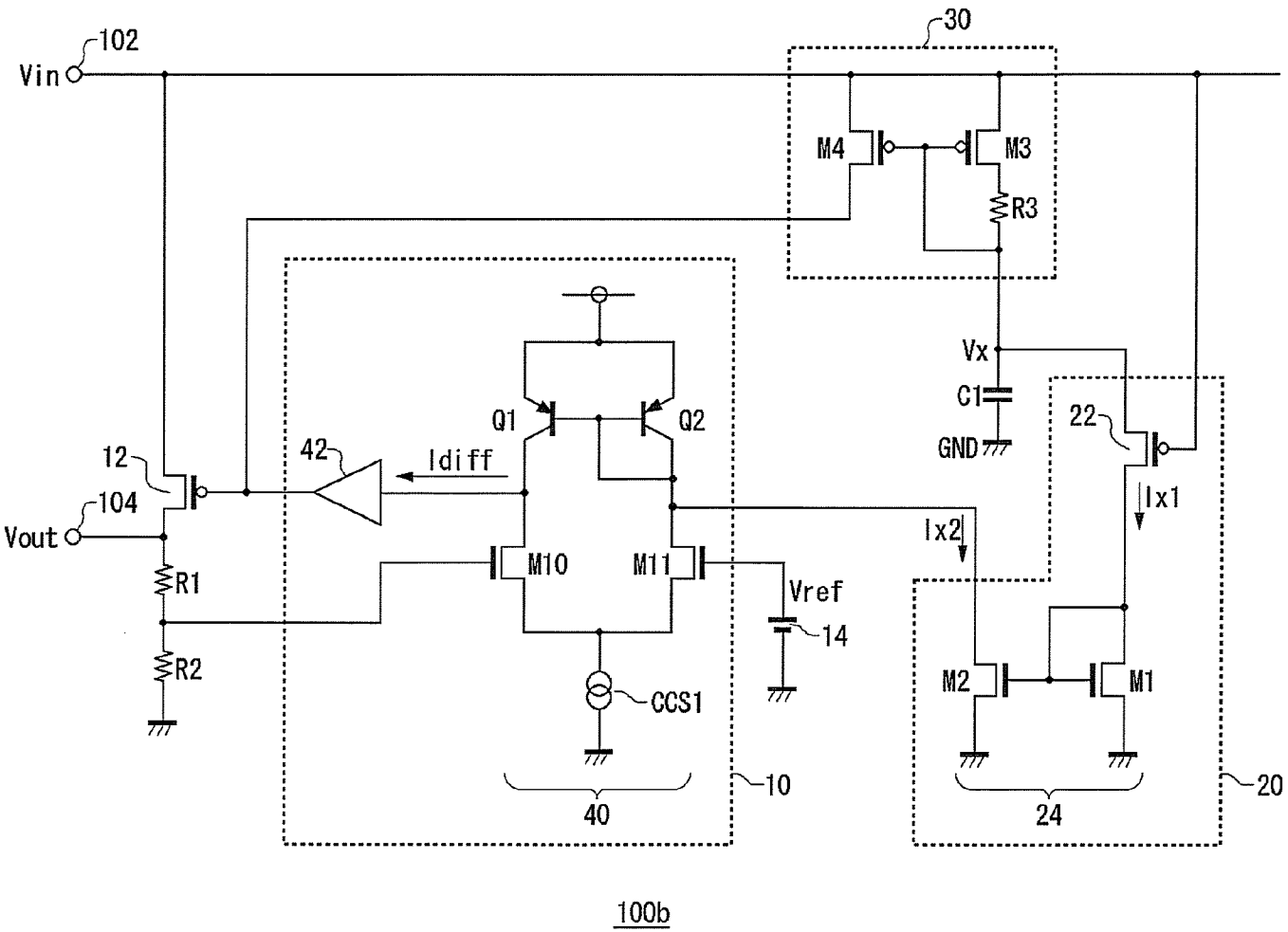
FIG. 4 is a circuit diagram which shows a configuration of a regulator circuit according to a second embodiment.

FIG. 4 is a circuit diagram which shows a configuration of a regulator circuit 100*b* according to a second embodiment of the present invention. The difference between the regulator circuit 100*b* according to the present embodiment and the regulator circuit 100*a* according to the first embodiment is that there is a difference in the operation of the undershoot suppressing circuit 20 therebetween. Description will be made below mainly regarding the aforementioned difference.

The undershoot suppressing circuit 20 of the regulator circuit 100*b* includes the detection transistor 22 and the current feedback circuit 24 in the same way as with the regulator circuit 100*a* shown in FIG. 1. Such an arrangement has a function of forcibly reducing the gate voltage of the output transistor 12 using the current that flows through the detection transistor 22.

The error amplifier 10 is an ordinary operational amplifier including a differential amplification circuit 40 and an amplification output stage 42. The differential amplification circuit 40 includes transistors M10 and M11, which form a differential pair, transistors Q1 and Q2, which form a current mirror circuit, and a constant current source CSS1 which generates a tail current Itail. The transistors Q1 and Q2 serve as constant current loads for the differential pair formed of the transistors M10 and M11. The gate of the transistor M11 serves as the inverting input terminal of the error amplifier 10. On the other hand, the gate of the transistor M10 serves as the non-inverting input terminal of the error amplifier 10.

The differential amplification circuit 40 amplifies the difference between the voltages input to the inverting input terminal thereof and the non-inverting terminal thereof, thereby creating the differential current Idiff. The amplification output stage 42 amplifies the differential current Idiff, and converts the differential current Idiff thus amplified into voltage, thereby outputting output voltage. Also, an operational amplifier, having any configuration including a differential amplifier in an input stage thereof, may be employed as the error amplifier 10.

The current feedback circuit 24 of the undershoot suppressing circuit 20 inputs the current Ix2, which corresponds to the current Ix1 that flows through the detection transistor 22, as a feedback signal for the differential current Idiff, to the differential amplification circuit 40 provided as an input stage of the error amplifier 10. With the present embodiment, the drain of the second transistor M2 of the undershoot suppressing circuit 20 is connected to the drain of the transistor M11 which is a component of the differential pair. With such an arrangement, in a case of increasing the current Ix2 generated by the undershoot suppressing circuit 20, the current Ix2 thus increased is added to the current that flows through the transistor M11, which serves as a feedback signal that reduces the differential current Idiff.

Next, description will be made regarding the operation of the regulator circuit 100*b* according to the present embodiment, again with reference to FIG. 2. At the point in time t1, something causes the input voltage Vin to rapidly drop. With such an arrangement, there is no discharge path for the charge stored in the fluctuation detection capacitor C1. Accordingly, in this case, the voltage Vx at the one terminal of the fluctuation detection capacitor C1 is not reduced immediately after a rapid drop in the input voltage Vin. As a result, the input voltage Vin becomes smaller than the voltage Vx at the one terminal of the fluctuation detection capacitor. In a case that the gate-source voltage of the detection transistor 22 becomes greater than a threshold voltage Vt, the detection transistor 22 is turned on, whereupon the current Ix1 flows.

The current feedback circuit 24 amplifies the current Ix1, and inputs the current Ix2 to the differential amplification circuit 40 as a feedback signal. In this case, the feedback signal reduces the differential current Idiff. Accordingly, in this case, the gate voltage Vg is forcibly reduced corresponding to the input voltage Vin. Thus, such an arrangement prevents the gate-source voltage of the output transistor 12 from becoming extremely small. This suppresses the output voltage Vout being undershot.

The regulator circuit 100*b* according to the present embodiment has the advantage of suppressing the output voltage Vout being undershot without increasing current consumption in a stable state, in the same way as with the regulator circuit 100*a* according to the first embodiment.

Third Embodiment

Figure 5:
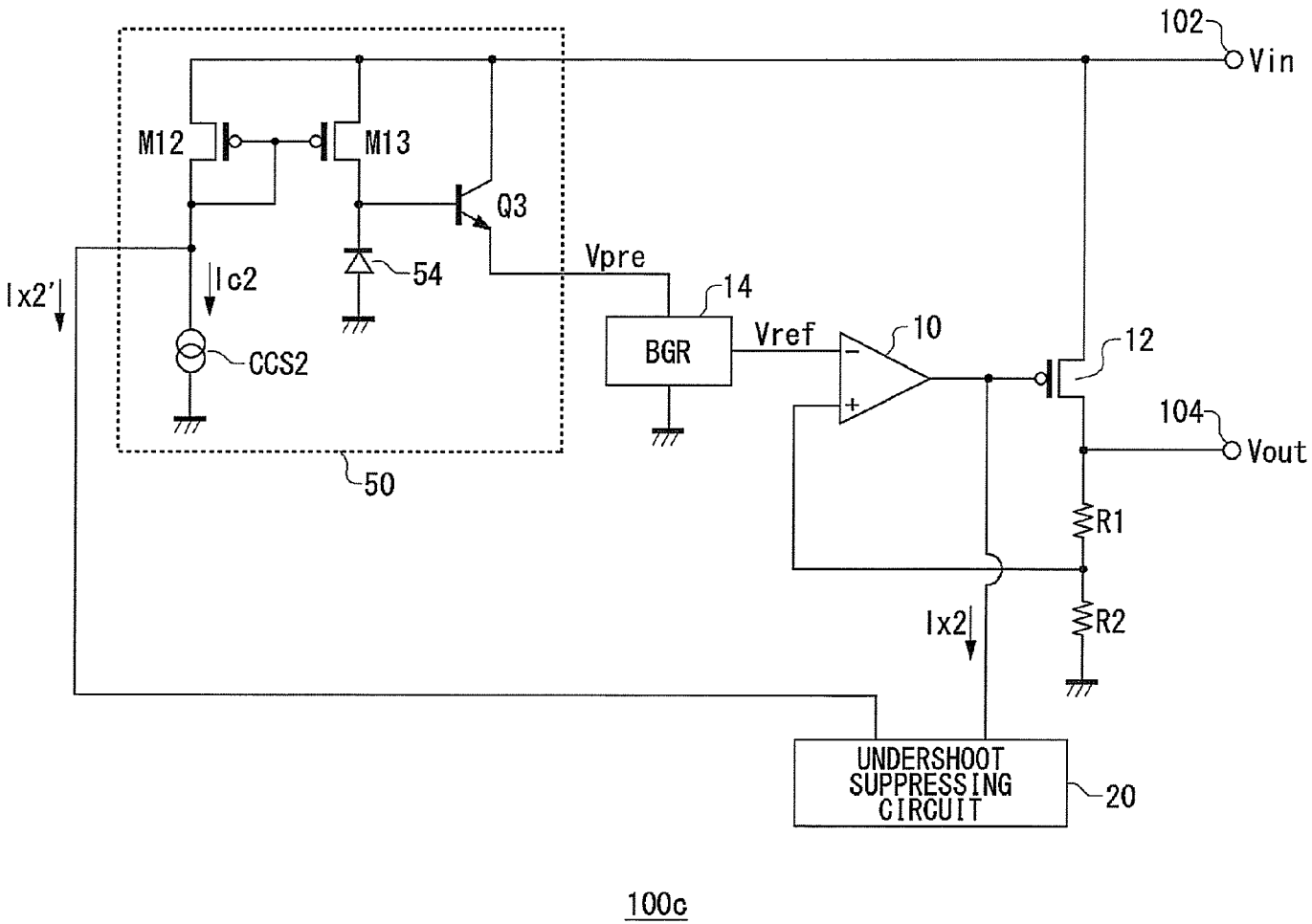
FIG. 5 is a circuit diagram which shows a configuration of a regulator circuit according to a third embodiment.

FIG. 5 is a circuit diagram which shows a configuration of a regulator circuit 100*c* according to a third embodiment. The regulator circuit 100*c* is a modification of the regulator circuit

100*a* according to the first embodiment shown in FIG. 1. A pre-regulator circuit 50, which supplies voltage to a reference voltage source 14, is included as a feature of the regulator circuit 100*c*.

The pre-regulator circuit 50 includes a constant current source CCS2, transistors M12, M13, and Q3, and a diode 54. The constant current source CCS2 generates a predetermined constant current Ic2. Based upon the current Ic2, the pre-regulator circuit 50 stabilizes the input voltage Vin input to the input terminal 102, and supplies the input voltage thus stabilized to the reference voltage source 14. With such an arrangement, the pre-regulator circuit 50 converts an input voltage Vin of 12 to 13 V to an output voltage Vpre of 3 to 7 V, for example.

The transistor M12 is a P-channel MOSFET, and is provided on the path of the constant current Ic2 generated by the constant current source CCS2. The source of the transistor M12 is connected to the input terminal 102, and the gate and drain thereof are connected to the constant current source CCS2. On the other hand, the transistor M13 is a P-channel MOSFET, which forms a current mirror circuit in cooperation with the transistor M12. The anode of the diode 54 is grounded, and the cathode thereof is connected to the drain of the transistor M13. The transistor Q3 is an NPN bipolar transistor. The collector of the transistor Q3 is connected to the input terminal 102, and the base thereof is connected to the drain of the transistor M13. The pre-regulator circuit 50 outputs the emitter voltage of the transistor Q3 as the output voltage Vpre. The base current (voltage) of the transistor Q3 is controlled according to the constant current Ic2 generated by the constant current source CCS2, thereby controlling the output voltage Vpre.

The reference voltage source 14 is a band-gap reference circuit, for example, which generates the reference voltage Vref based upon the output voltage Vpre output from the pre-regulator circuit 50.

The undershoot suppressing circuit 20 generates the current Ix2' that corresponds to the current Ix1 that flows through the detection transistor 22. The current Ix2' can be obtained from the undershoot suppressing circuit 20 having the following configuration. That is to say, with such an arrangement, an additional transistor is provided to the undershoot suppressing circuit 20 shown in FIG. 1, specifically, in parallel with the first transistor M1 and the second transistor M2. Furthermore, the gates of these transistors are connected to each other so as to form a common gate, thereby generating the current Ix2'. The undershoot suppressing circuit 20 adds the current Ix2' to the constant current Ic2 generated by the constant current source CCS2.

Description will be made regarding the operation of the regulator circuit 100*c* according to the present embodiment.

Let us consider a case in which the input voltage Vin, i.e., the power supply voltage Vdd, drops to a range in which the constant current source CCS2 cannot effectively operate. In this case, in general, the constant current Ic2 is not generated, leading to reduction in the output voltage Vpre output from the pre-regulator circuit 50. In a case that an extreme drop occurs in the output voltage Vpre output from the pre-regulator circuit 50, the reference voltage source 14 cannot generate the reference voltage Vref, leading to a situation in which the regulator circuit 100*c* cannot stably maintain the output voltage Vout at a desired value.

With the regulator circuit 100*c* according to the present embodiment, in a case that the input voltage Vin at the input terminal 102 drops, the current Ix1 flows through the detection transistor 22. Furthermore, the current Ix2' that corresponds to the current Ix1 is generated. Let us consider a case in which the constant current source CCS2 does not effectively operate. Even in this case, the current Ix2', which has been created by the undershoot suppressing circuit 20, flows through the transistor M12. The current Ix2' is amplified by the transistors M12 and M13, and is supplied to the transistor Q3 as the base current. Thus, such an arrangement prevents the output voltage Vpre from dropping even in a case that the input voltage Vin drops. Thus, such an arrangement stabilizes the reference voltage Vref generated by the reference voltage source 14. Furthermore, the reference voltage Vref thus stabilized enables the regulator circuit 100*c* to provide a stable output voltage Vout.

Figure 6:
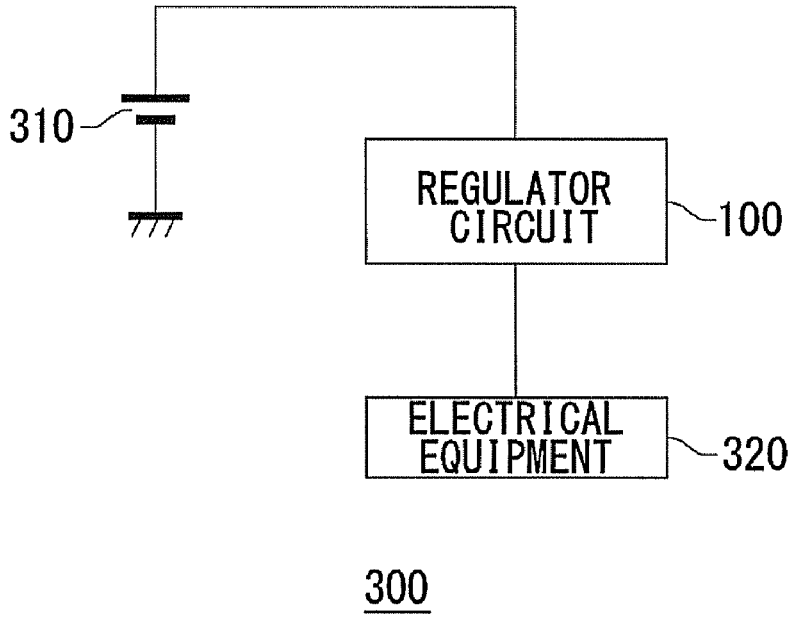
FIG. 6 is a block diagram which shows a part of an automobile mounting a regulator circuit according to any one of the first through third embodiments.

Lastly, description will be made regarding the uses of the above-described regulator circuits 100*a* through 100*c* (which will be collectively referred to as "regulator circuit 100" hereafter). The regulator circuit 100 is mounted on an automobile, for example. FIG. 6 is a block diagram which shows an electrical system of an automobile 300 mounting the regulator circuit 100. The automobile 300 includes a battery 310, the regulator circuit 100, and electrical equipment 320. The battery 310 outputs a battery voltage Vbat of around 13 V. The battery voltage Vbat is output via a relay, leading to a problem of fluctuation of the voltage value over time. On the other hand, examples of the electrical equipment 320 include a car stereo system, a car navigation system, illumination LEDs provided to an interior panel, etc., each of which is a load that requires a stable power supply voltage which does not fluctuate over time. The regulator circuit 100 reduces the battery voltage Vbat to a predetermined voltage, and outputs the voltage thus reduced to the electrical equipment 320.

As described above, the regulator circuit 100 described in the embodiments has a function of high speed control of the output voltage Vout following a rapid change in the input voltage Vin or the output current Iout, thereby almost entirely suppressing undershooting and overshooting of the output voltage Vout. Thus, the regulator circuit 100 can be suitably employed in order to obtain a stable voltage from a power supply that has a problem of large fluctuations in the output voltage, such as a battery mounted on an automobile.

The use of the regulator circuit 100 described in the embodiments is not restricted to such a use in an automobile. Also, the regulator circuit 100 can be applied to various applications in which the input voltage is stabilized before the input voltage is supplied to a load.

The above-described embodiments have been described for exemplary purposes only, and are by no means intended to be interpreted restrictively. Rather, it can be readily conceived by those skilled in this art that various modifications may be made by making various combinations of the aforementioned components or processes, which are also encompassed in the technical scope of the present invention.

Each of the components of the regulator circuits 100*a* through 100*c* according to the first through third embodiments provides the above-described functions and advantages in a case that the component is employed independently. Also, any combination thereof may be made. Such a combination more properly and suitably suppresses undershooting and overshooting of the output voltage.

In the embodiments, each MOSFET employed for exemplary purposes may be replaced by a bipolar transistor. Also, each bipolar transistor employed for exemplary purposes may be replaced by a MOSFET. These transistors are interchangeable. Any interchanging of these transistors should be determined based upon the design specifications required in designing the regulator circuit, the semiconductor manufacturing process used for manufacturing the regulator circuit, and so forth. Also, a modification may be made in which the relation between the power supply voltage and the grounded electric potential is inverted as compared to that in the present embodiment. With such a modification, each P-channel MOSFET is replaced by an N-channel MOSFET, and each PNP transistor is replaced by a corresponding NPN transistor. Also, an additional resistor may be inserted. It is needless to say that such a modification is also encompassed in the technical scope of the present invention.

In the embodiments, all the components of any of the regulator circuit 100*a* through 100*c* may be integrally formed. Also, a part thereof may be provided in the form of a discrete component. Which part is to be provided in the form of an integrated circuit should be determined based upon costs, the amount of space to be occupied, etc.

While the preferred embodiments of the present invention have been described using specific terms, such description is for illustrative purposes only, and it is to be understood that changes and variations may be made without departing from the spirit or scope of the appended claims.

What is claimed is:

1. A regulator circuit, which stabilizes an input voltage applied to an input terminal, and which outputs an output voltage via an output terminal, comprising:

an output transistor provided between the input terminal and the output terminal;

an error amplifier which adjusts a voltage at a control terminal of said output transistor such that the voltage that corresponds to the output voltage approaches a predetermined reference voltage;

a fluctuation detection capacitor which is provided on a path from the input terminal to the grounded terminal, and one terminal of which is set to a fixed electric potential; and an undershoot suppressing circuit configured to extract a first current from the fluctuation detection capacitor and to extract a current proportional to the first current from the control terminal of the output transistor so as to forcibly reduce the voltage at the control terminal of said output transistor when the input voltage is lower than the voltage at the other terminal of said fluctuation detection capacitor.

2. A regulator circuit according to claim 1, wherein said undershoot suppressing circuit includes a detection transistor which is provided on a path from the other terminal of said fluctuation detection capacitor to the grounded terminal, and the control terminal of which is connected to said input terminal, and wherein said undershoot suppressing circuit has a function of forcibly reducing the voltage at the control terminal of said output transistor using the current that flows through said detection transistor.

3. A regulator circuit according to claim 2, wherein said detection transistor is a P-channel field effect transistor, the gate of which is connected to said input terminal, and the source of which is connected to the other terminal of said fluctuation detection capacitor.

4. A regulator circuit according to claim 2, wherein said undershoot suppressing circuit includes a current feedback circuit which extracts from the control terminal of said output transistor a current that corresponds to a current that flows through said detection transistor.

5. A regulator circuit according to claim 4, wherein said current feedback circuit includes:

a first transistor which is provided on the path of said detection transistor; and a second transistor which, together with said first transistor, forms a current mirror circuit, and one terminal of which is connected to the control terminal of said output transistor.

6. A regulator circuit according to claim 2, wherein said undershoot suppressing circuit further includes a current feedback circuit which inputs a current, which corresponds to a current that flows through said detection transistor, as a feedback signal for a differential current output from a differential amplification circuit provided as an input stage of said error amplifier.

7. A regulator circuit according to claim 6, wherein said current feedback circuit includes:

a first transistor provided on the path of said detection transistor; and a second transistor which, together with said first transistor, forms a current mirror circuit, and one terminal of which is connected to one component that forms the differential pair for said differential amplification circuit provided as an input stage of said error amplifier.

8. A regulator circuit according to claim 1, further including an overshoot suppressing circuit which provides a function whereby, in a case that a current flows from said input terminal into the other terminal of said fluctuation detection capacitor, the voltage at the control terminal of said output transistor is forcibly raised.

9. A regulator circuit according to claim 8, wherein said overshoot suppressing circuit supplies to the control terminal of said output transistor a current that corresponds to the current that flows from said input terminal into the other terminal of said fluctuation detection capacitor.

10. A regulator circuit according to claim 9, wherein said overshoot suppressing circuit includes:

a third transistor provided on a path from said input terminal to the other terminal of said fluctuation detection capacitor; and a fourth transistor which, together with said third transistor, forms a current mirror circuit, and one terminal of which is connected to the control terminal of said output transistor.

11. A regulator circuit according to claim 2, further including:

a pre-regulator circuit which stabilizes the power supply voltage input to said input terminal, based upon a constant current generated by a constant current source; and a reference voltage generating circuit which generates the reference voltage based upon the output voltage of said pre-regulator circuit, wherein said undershoot suppressing circuit adds to the constant current a current that corresponds to the current flowing through said detection transistor.

12. A regulator circuit according to claim 1, wherein said circuit is integrally formed on a single semiconductor substrate.

13. An automobile including:

a battery; and a regulator circuit according to claim 1, which stabilizes the voltage supplied from said battery before supplying the output voltage to a load.

14. A regulator circuit, which stabilizes an input voltage applied to an input terminal, and which outputs an output voltage via an output terminal, comprising:

an output transistor provided between the input terminal and the output terminal;

an error amplifier which adjusts a voltage at a control terminal of said output transistor such that the voltage that corresponds to the output voltage approaches a predetermined reference voltage;

a fluctuation detection capacitor which is provided on a path from the input terminal to the grounded terminal, and one terminal of which is set to a fixed electric potential; and an overshoot suppressing circuit configured to supply a second current to the other terminal of the fluctuation detection capacitor and to supply a current proportional to the second current to the control terminal of said output transistor so as to forcibly raise the voltage at the control terminal of said output transistor when a current flows from said input terminal into the other terminal of said fluctuation detection capacitor.

15. A regulator circuit according to claim 14, wherein said overshoot suppressing circuit includes:

a third transistor provided on a path from said input terminal to the other terminal of said fluctuation detection capacitor; and a fourth transistor which, together with said third transistor, forms a current mirror circuit, and one terminal of which is connected to the control terminal of said output transistor.

16. A regulator circuit according to claim 14, wherein said circuit is integrally formed on a single semiconductor substrate.

17. An automobile including:

a battery; and a regulator circuit according to claim 14, which stabilizes the voltage supplied from said battery before supplying the output voltage to a load.

* * * * *